United States Patent [19]

Eich

[11] Patent Number: 5,014,539

[45] Date of Patent: May 14, 1991

[54] CRIMP PRESS

[76] Inventor: Dieter K. Eich, Muhle CH-6260, Reiden, Switzerland

[21] Appl. No.: 464,118

[22] Filed: Jan. 11, 1990

[30] Foreign Application Priority Data

Jan. 13, 1989 [CH] Switzerland ..... 111/89

[51] Int. Cl.[5] ..... B21J 9/18

[52] U.S. Cl. ..... 72/452; 72/456; 100/291; 100/292; 74/50

[58] Field of Search ..... 72/452, 456; 100/291, 100/292; 74/50

[56] References Cited

U.S. PATENT DOCUMENTS

| | | | |
|---|---|---|---|
| 3,339,481 | 9/1967 | Lang | 72/452 |
| 3,451,276 | 6/1969 | Wadlow | 74/50 |
| 3,621,702 | 11/1971 | Kralowetz | 72/452 |

FOREIGN PATENT DOCUMENTS

| | | | |
|---|---|---|---|
| 0253360 | 7/1966 | Austria | 100/292 |
| 0057728 | 3/1987 | Japan | 72/452 |
| 0683917 | 9/1979 | U.S.S.R. | 100/292 |

*Primary Examiner*—David Jones

*Attorney, Agent, or Firm*—Thomas W. Speckman; Douglas H. Pauley

[57] ABSTRACT

A crimp press having an eccentric guide in which an eccentric tang having a bearing runs. In contrast to the known eccentric guides, the eccentric guide is not straight but instead has a curved region on one side. As a result, during the first 90° of the eccentric shaft rotation, the tappet covers the greatest part of the stroke path, and in the second 90° of rotation of the eccentric shaft, only a short stroke path is executed, during which the deformation of the contact takes place. A crimp press with the eccentric guide has a more lightweight structure, is equipped with a smaller reduction gear and requires a lower rotational speed of the drive motor, as compared to conventional crimp presses.

5 Claims, 4 Drawing Sheets

CRIMP PRESS

BACKGROUND OF THE INVENTION

1. Field of the Invention

This invention relates to an impact or crimp press for joining contact parts to a conductor, in which an electric motor, via a reduction gear, drives an eccentric shaft which has an eccentric tang that moves in a guide and vertically reciprocates a tappet and a crimping tool.

2. Description of the Prior Art

Various versions of impact or crimp presses of this type are available on the market. In principle, a distinction is made between presses that work with an eccentric and those that use a knee lever system. Crimp presses that use knee lever systems are on the decline, because they have many parts subject to wear and correspondingly dictate voluminous construction with relatively high dimensional accuracy. Crimp presses that have eccentrics are more widely used. In crimp presses that have eccentrics, the induction of force is relatively unfavorable and a high gear reduction ratio is necessary, for example, by means of a spur wheel or worm gears. The high gear reduction, however, requires that the drive motor be accelerated from 0 to approximately 4000 to 5000 rpm and then decelerated to 0 rpm, for each working cycle. Accordingly, the drive motors are heavily loaded and tend to overheat, which considerably reduces their service life.

SUMMARY OF THE INVENTION

It is an object of the present invention to improve an impact or crimp press, of the type in which an electric motor, via a reduction gear, drives an eccentric shaft which has an eccentric tang that moves in a guide and vertically reciprocates a tappet and a crimping tool, in such a way that the stroke path of the tappet varies in proportion to the path of the circular motion of the eccentric tang in the downward movement to bottom dead center, and in such a way that approximately a one-fourth rotation of the eccentric shaft is available for the last approximately 10% of the stroke path.

This object is achieved by an impact or crimp press for joining contact parts to a conductor. The crimp press includes an electric motor which drives a reduction gear. The reduction gear drives an eccentric shaft which has an eccentric tang. The eccentric tang moves in a guide track. The guide track is used to vertically reciprocate a tappet and a crimping tool. The guide track curves upward from an initial position on at least one side.

Since this makes the force/path ratio much more favorable, work can be done with a much lower reduction. Consequently, a much lower rotational speed is required by the drive motor to perform a pressing operation in the same cycle time. With a crimp press according to this invention, work is done with a maximum rotational speed of 1100 rpm, and a cycle time of 0.26 seconds. The considerably lower reduction makes it possible, for the first time, to drive a crimp press with a toothed belt gear system.

BRIEF DESCRIPTION OF THE DRAWINGS

Further features of this invention will be apparent from the following more detailed description taken in conjunction with the drawing wherein.

DESCRIPTION OF A PREFERRED EMBODIMENT

A complete detailed view of a conventional crimp press has been omitted from this specification, because such design is well known in the art. Nevertheless, its basic structure is briefly described in this specification.

Figure 1:
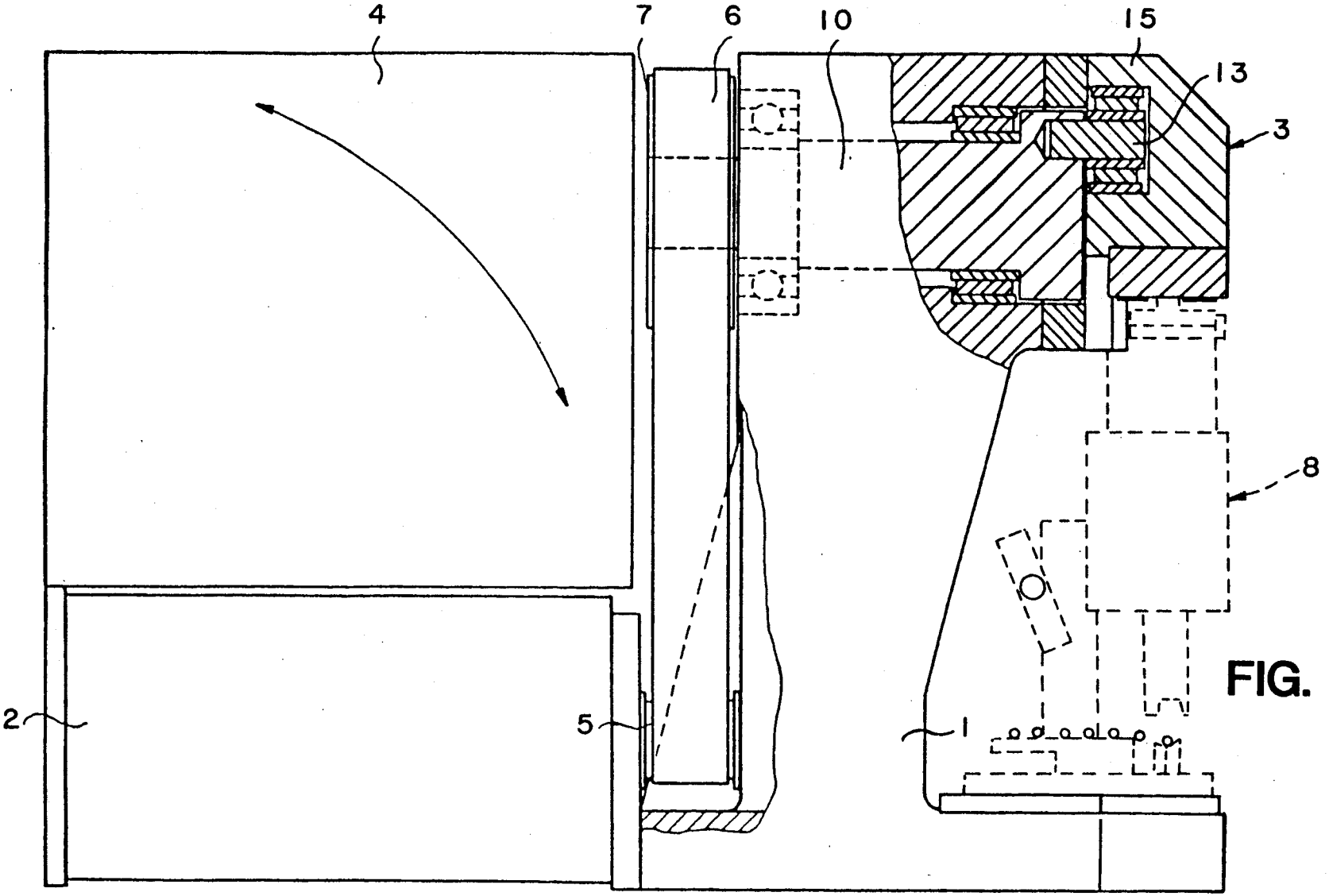
FIG. 1 is a partial cross-sectional front view of a crimp press.

As shown in FIG. 1, synchronous electric motor 2 is mounted on a machine frame. Electric motor 2 is used to drive eccentric shaft 10 through a reduction gear comprised of toothed pinion wheel 5 on the motor shaft, toothed gear wheel 6 on the eccentric shaft and toothed belt 7. Eccentric shaft 10 supports an eccentric which has eccentric tang 13. Eccentric tang 13 is located in a guide, which is part of tappet 3 that vertically reciprocates. Attached to tappet 3 is an interchangeable tool 8, with which metal contacts such as through connectors, end connectors, cable shoes and lug inserters can be pressed onto cables, and in particular stranded cables. The electronic control system is housed in hinged box 4.

Figure 2:
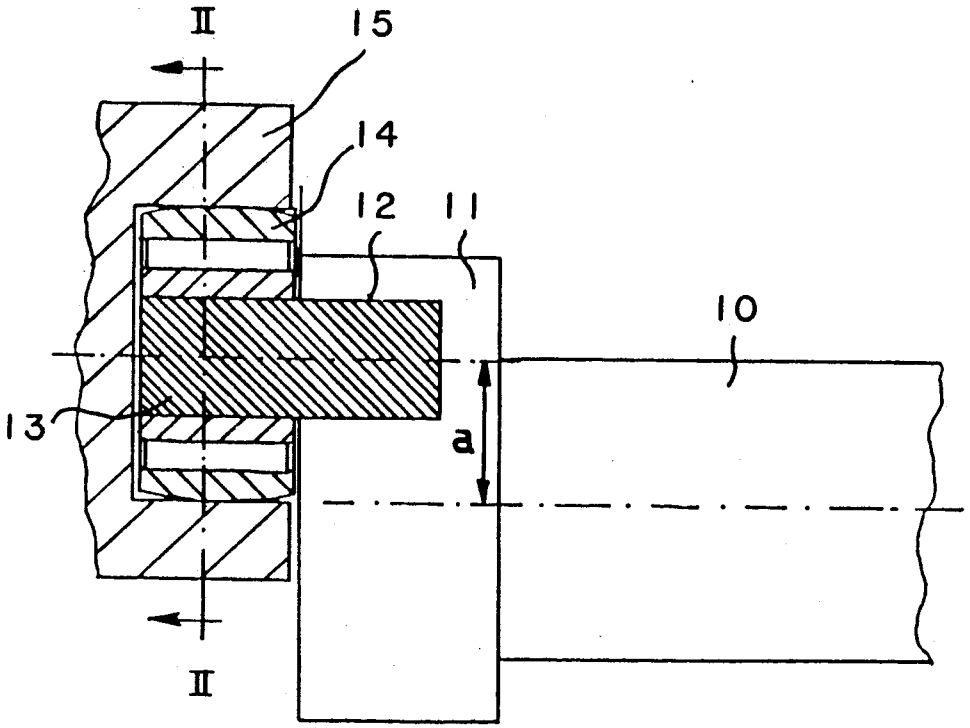
FIG. 2 is a partial cross-sectional view of the eccentric shaft and an eccentric tang, supported in an eccentric guide.

Eccentric shaft 10 is shown in detail in FIG. 2. Eccentric shaft 10 has flange 11 at one end. Flange 11 has eccentrically disposed bore 12. Eccentric tang 13 is press fitted in bore 12. Radial roller bearing 14 is fitted onto a part of eccentric tang 13 protruding from bore 12. Roller bearing 14 fits with a close tolerance into eccentric guide, or guide track 15. Eccentric guide 15 is set let directly into tappet 3.

Figure 4:
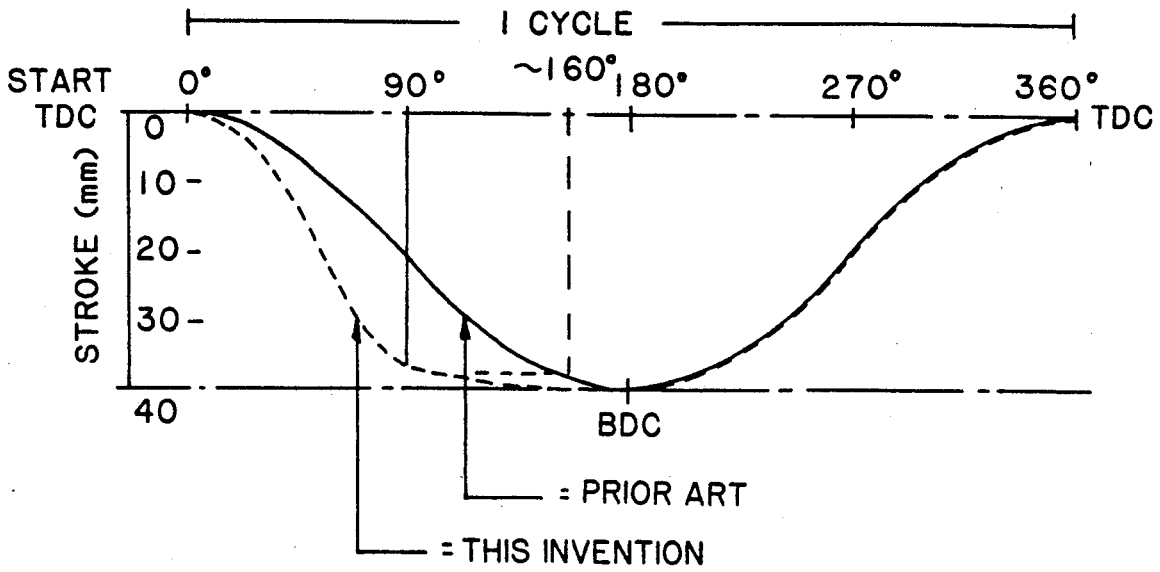
FIG. 4 is a graph which shows a stroke path of an eccentric tang as a function of the angular position of the eccentric shaft.

Before eccentric guide 15 or the guide track which is essential to the invention is described, a conventional eccentric guide or guide track is briefly described. It is well known that a circular motion can be broken down into two sinusoidal oscillating motions in a vertical and a horizontal direction. The vertical component is used for moving a tappet and a tool secured to it. The horizontal component is absorbed in the eccentric guide or guide track and makes no contribution to the transmission of the force of the tool to the work piece. The guide track for the eccentric bolt is linearly horizontal and is embodied as either an open guide track with an upper and lower slide plate, or as a closed guide track. In the initial position, the eccentric is at top dead center (TDC), and the tappet is in its uppermost stroke position, with the eccentric tang located in the middle of the guide track. Upon its clockwise motion, the bearing rolls off onto the eccentric tang on the underside, until after 90° it has reached the outermost lateral deflection and returns back toward the middle of the guide track. The eccentric tang regains after a 180° rotation of the eccentric shaft, whereupon the tappet has reached the lowermost point of its stroke motion. The upward stroke motion of the tappet and the oscillation of the eccentric tang in the other lateral direction within the guide track then takes place. As shown in FIG. 4, the solid line represents this course of motion. As shown in FIG. 4, the stroke path can be seen as a function of the rotational angle of the eccentric shaft. The press must bring the entire deforming force to bear in the last 2 mm of the stroke path. The deforming or pressing force amounts to approximately two metric tons. In a conventional press, a rotational angle of approximately 20° remains for building these two tons of pressing force. This is represented by the curve shown in solid lines in the diagram of FIG. 5.

Figure 3:
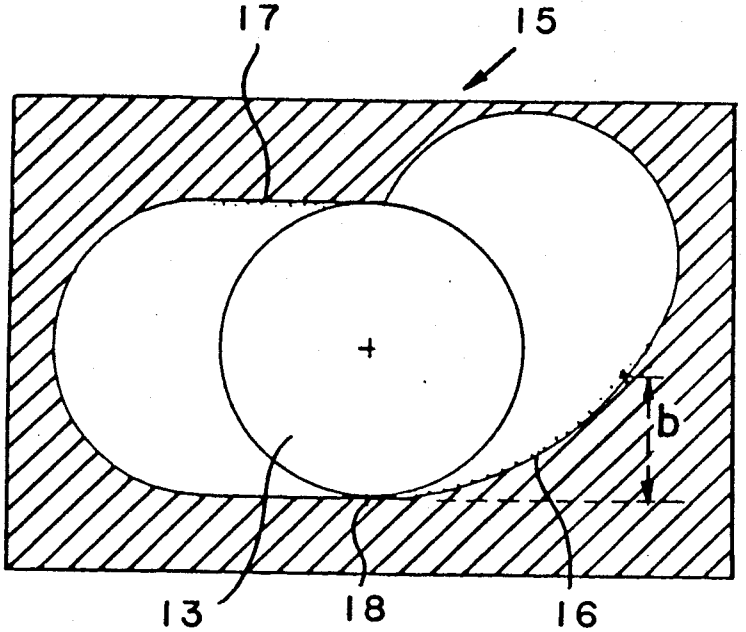
FIG. 3 is a partial cross-sectional view of the eccentric guide along line II—II of FIG. 2.

As shown in FIG. 3, eccentric guide or guide track 15 according to this invention has lower guide region 16. Lower guide region 16 curves circularly upward in one direction from the middle with respect to the entire horizontal displacement region. Eccentric guide 15 also has upper guide region 17, which also extends from the middle, horizontally in the opposite direction.

The total stroke of the tool is specified by the motion of eccentric tang 13 and amounts to twice the spacing (a) between a longitudinal axis of eccentric shaft 10 and a longitudinal axis of eccentric tang 13. The axis of eccentric tang 13 also migrates to both sides from the middle of guide track 15 by this distance (a). From top dead center, TDC, at 0°, roller bearing 14 rolls off to the right on lower curved guide region 16. In this process, tappet 3, in which guide track 15 is positioned, is additionally moved downward by the spacing (b), namely the distance by which the contact point of roller bearing 14 has moved vertically upward from lower bottom point 18. The function requires that the radius of curvature of lower curved guide region 16 be greater than the diameter of roller bearing 14 rolling within guide track 15.

Figure 6:
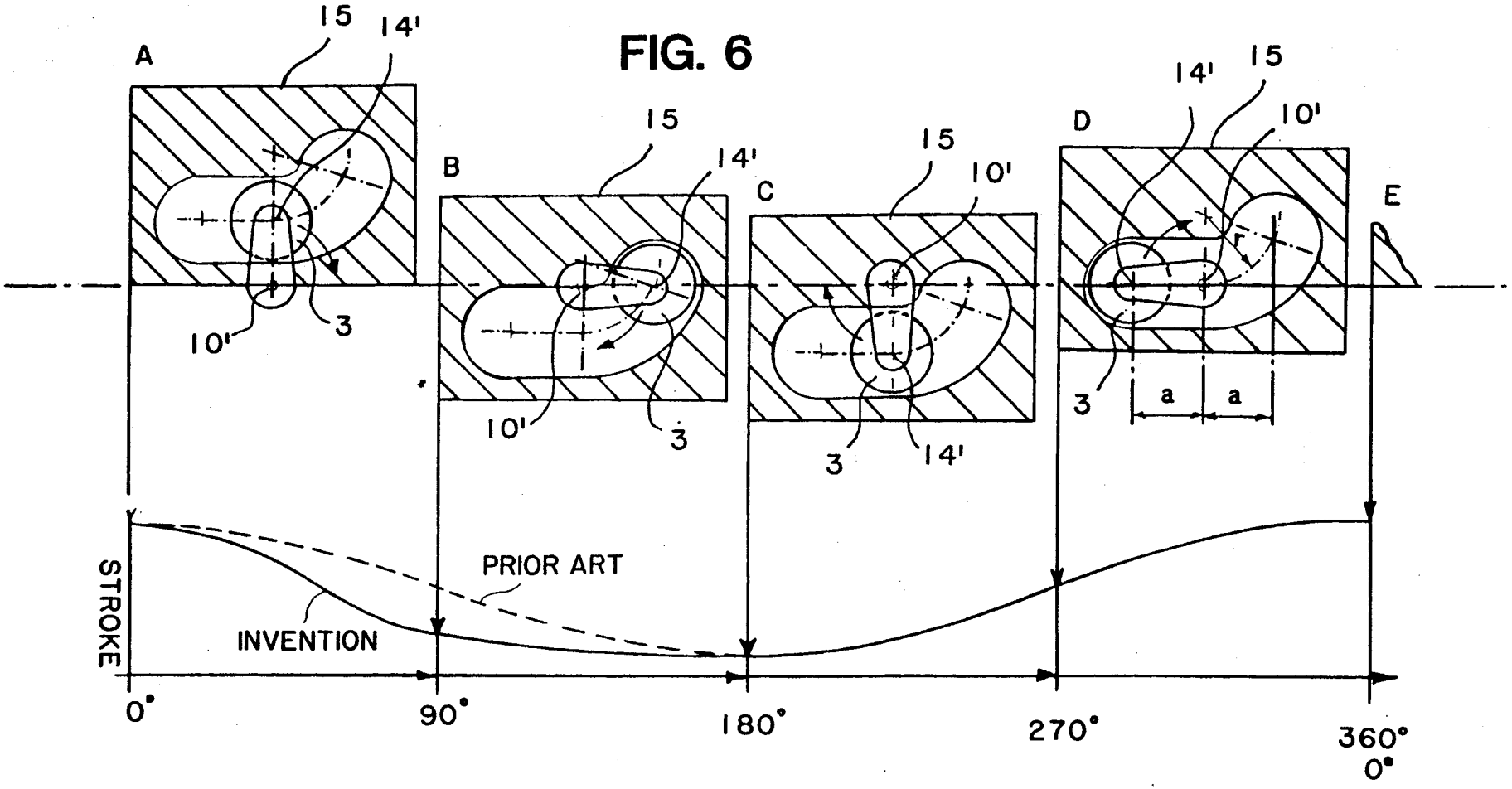
FIG. 6 is a schematic view of the various stages of movement of the roller bearing in relation to the guide track used in the press of the invention.

FIG. 6 shows schematically the movement of the roller bearing 14 in relation to the guide track 15 as used in the press of this invention and the resulting tappet stroke. The center of the eccentric shaft is indicated by a circle 10' and the center of the roller bearing is indicated by a point designated by 14'. These two points are connected by a symbolic lever arm of length "a" symbolizing the eccentricity of tang 13 with respect to the center of shaft 10. The trappet 3 is shown in four positions; position A at the uppermost position of its stroke of 0° rotation of the eccentric shaft 10; position B at 90% of its downward stroke after only 90° rotation of the eccentric shaft; position C at 100% of its downward stroke after rotation of the shaft 180°; position D in the middle of its upward stroke after rotation of the shaft 270°; and position E again at the uppermost position of its stroke after 360° rotation of the shaft, identical to its position at 0° shaft rotation. As shown in FIG. 6, the essential aspect of this invention occurs between tappet position B and C where the tappet moves the remaining 10% of its downward stroke to close the crimping press by rotating the shaft 90°.

It is typical to define the stroke path of tappet 3 as 40 mm. Normally, however, the deformation of the contact, the work piece, does not occur until the final 2 mm of the stroke path. Consequently, a relatively large pressing force is generated only in these 2 mm. If eccentric guide or guide track 15 is dimensioned such that the difference between the distances (a) and (b) is precisely 2 mm, then the entire buildup of pressure is distributed over approximately 90° of eccentric shaft 10 rotation, unlike the prior art in which this pressure is built up only over a rotational angle extending from 10° to 20°.

Figure 5:
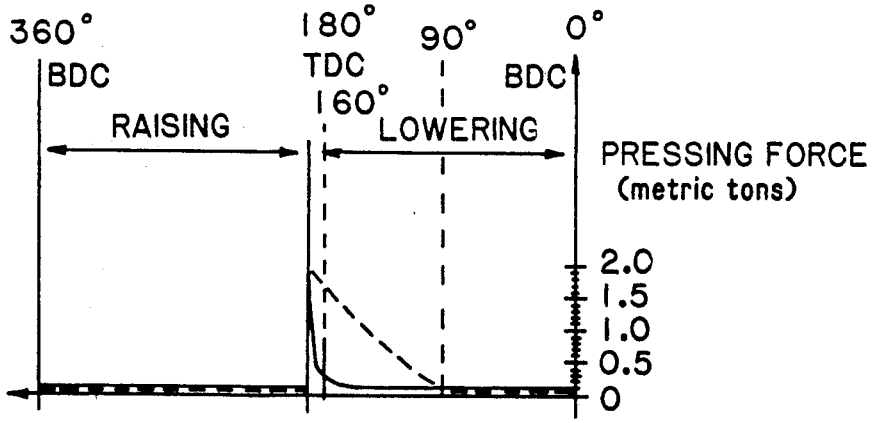
FIG. 5 is a graph which shows a curve of the force as a function of the angular position of the eccentric shaft.

This situation is clearly apparent from the two diagrams of FIGS. 4 and 5. As shown in FIGS. 4 and 5, in the range between 0° and 90°, the dashed-line curve extends considerably more steeply, while from 90° to 180° the curve becomes very flat. The force/rotational angle curve from 90° to 180° similarly increases nearly continuously, while previously, in conventional eccentric guides, a very narrow peak resulted.

This low force per degree of rotation means that a much lesser reduction is needed. This is the first time that such a reduction can be achieved in an impact or crimp press driven by a toothed belt gear (5, 6, 7). This was impossible, given the reduction ratios that were previously necessary. As shown in FIG. 1, electric motor 2 is connected to drive shaft 5 which is connected to toothed belt 6. Toothed belt 6 transmits the torque to drive wheel 7 of eccentric shaft 10. As a consequence of the low reduction, electric motor 2 must achieve a much lower rotational speed to attain an identical or even shorter cycle time.

I claim:

1. In a crimp press for joining contact parts to a conductor, having an electric motor connected to a reduction gear, the reduction gear drives an eccentric shaft having an eccentric tang, the eccentric tang moves upon rotation of the eccentric shaft in a guide track, the guide track is set into a tappet, the movement of the tang in the guide track vertically reciprocates the tappet and a crimping tool, the improvement comprising: said guide track (15) having an upward arcuate slope, said tang movable within said guide track in a cycle starting from a central position, upon an initial 90° rotation of the eccentric shaft said tang first moving along said upward arcuate slope, and upon said initial 90° rotation said tappet starting from an uppermost position and moving downward through more than 75% of a complete downward stroke.

2. A crimp press according to claim 1, further comprising a roller bearing (14), said roller bearing being connected to said eccentric tang (13), said eccentric tang protruding from a flange (11) on the end of said eccentric shaft (10), and said roller bearing (14) rolling in said guide track (15).

3. A crimp press according to claim 1, further comprising a roller bearing (14) of a diameter at least approximately two times a distance (a), said eccentric shaft having a longitudinal shaft axis and said eccentric tang having a longitudinal tang axis wherein said distance (a) is between said longitudinal shaft axis of said eccentric shaft (10) and said longitudinal tang axis of said eccentric tang (13).

4. A crimp press according to claim 1, further comprising said eccentric shaft (10) having a longitudinal shaft axis and said eccentric tang (13) having a longitudinal tang axis, wherein a distance (a) minus a distance (b) is greater than or equal to a stroke path on which crimping tools deform a work piece, said distance (a) being between said longitudinal shaft axis of said eccentric shaft (10) and said longitudinal tang axis of said eccentric tang (13), and said distance (b) being a maximum vertical deflection of said eccentric tang (13) in said guide track (15).

5. A crimp press according to claim 1, wherein the reduction gear further comprises a toothed belt gear system (5, 6, 7).

* * * * *